US007234397B2

(12) United States Patent
Schäfer

(10) Patent No.: US 7,234,397 B2
(45) Date of Patent: Jun. 26, 2007

(54) DEVICES FOR FIXING AT LEAST ONE PACKING TO A CYLINDER OF A ROTARY PRINTING PRESS AND PRINTING GROUP COMPRISING SAID DEVICES

(75) Inventor: Karl Robert Schäfer, Rimpar (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 215 days.

(21) Appl. No.: 10/511,434

(22) PCT Filed: Apr. 24, 2003

(86) PCT No.: PCT/DE03/01332

§ 371 (c)(1),
(2), (4) Date: Oct. 25, 2004

(87) PCT Pub. No.: WO03/091024

PCT Pub. Date: Nov. 6, 2003

(65) Prior Publication Data

US 2005/0160932 A1 Jul. 28, 2005

(30) Foreign Application Priority Data

Apr. 25, 2002 (DE) ..... 102 18 474

(51) Int. Cl.
*B41F 27/12* (2006.01)

(52) U.S. Cl. ..... 101/415.1; 101/378

(58) Field of Classification Search ..... 101/415.1, 101/378, 409

See application file for complete search history.

(56) References Cited

U.S. PATENT DOCUMENTS

| | | | | |
|---|---|---|---|---|
| 3,362,327 | A * | 1/1968 | Luehrs | 101/415.1 |
| 4,938,134 | A * | 7/1990 | Dorsam et al. | 101/415.1 |
| 5,396,843 | A | 3/1995 | Durr | |
| 5,485,783 | A | 1/1996 | Rau et al. | |
| 5,778,786 | A | 7/1998 | Metrope | |
| 5,809,890 | A | 9/1998 | Knauer et al. | |
| 5,921,183 | A | 7/1999 | Jones | |
| 6,543,358 | B1 | 4/2003 | Schneider et al. | |
| 6,598,530 | B1 | 7/2003 | Schneider et al. | |
| 6,675,708 | B2 * | 1/2004 | Schneider et al. | 101/415.1 |
| 6,862,991 | B2 | 3/2005 | Schafer | |
| 2002/0189470 | A1 * | 12/2002 | Holm | 101/375 |
| 2004/0050276 | A1 | 3/2004 | Schafer | |

FOREIGN PATENT DOCUMENTS

DE 261 768 A1 2/1987

(Continued)

*Primary Examiner*—Leslie J. Evanisko
(74) *Attorney, Agent, or Firm*—Jones, Tullar & Cooper, P.C.

(57) ABSTRACT

Devices are used for fixing or attaching at least one packing or dressing to a cylinder. A retaining element is located in a channel in the cylinder and retains one end of the dressing or packing. A spring element is also located in the channel and cooperates with the retaining element to exert a required clamping force on the end of the packing or dressing. The retaining element is pivotably supported in the base of the channel and is fixed in the base, while in its clamping portion, by the spring element. This insures that the retaining element will not be inadvertently unclamped from the channel.

28 Claims, 3 Drawing Sheets

FOREIGN PATENT DOCUMENTS

| | | |
|---|---|---|
| DE | 42 44 077 C 2 | 12/1992 |
| DE | 43 19 167 C 2 | 6/1993 |
| DE | 196 19 941 | 1/1997 |
| DE | 197 01 046 | 7/1997 |
| DE | 198 01 689 A1 | 1/1998 |
| DE | 199 24 785 | 12/2000 |
| DE | 199 24 787 | 12/2000 |
| DE | 100 58 996 | 6/2002 |
| WO | WO 02/43962 A2 | 6/2002 |

* cited by examiner

DEVICES FOR FIXING AT LEAST ONE PACKING TO A CYLINDER OF A ROTARY PRINTING PRESS AND PRINTING GROUP COMPRISING SAID DEVICES

CROSS-REFERENCE TO RELATED APPLICATIONS

This application is the U.S. National Phase, under 35 USC 371 of PCT/DE03/01332, filed Apr. 24, 2003; published as WO 03/691024 A1 on Nov. 6, 2003 and claiming priority to DE 102 18 474.7, filed Apr. 25, 2002, the disclosures of which are expressly incorporated herein by reference.

FIELD OF THE INVENTION

The present invention is directed to devices for fastening at least one dressing or packing on a cylinder of a rotary printing press and to a printing group having these devices.

BACKGROUND OF THE INVENTION

A device for use in bracing and/or clamping flexible plates, having beveled suspension legs, is described in DE 199 24 785 A1. A first suspension leg is arranged in a cylinder groove in a manner wherein it can be pressed against a groove wall by a pivotably seated profiled strip, which is provided with three arms. Another suspension leg, with a clamping roller, is arranged to be pressed against another location of the groove wall. The strip can be divided into several shorter profiled strips. Alternatively, a support strip supporting the profiled strip can be divided into several shorter support strips. Adjoining support strips are connected with each other by a coupling, for example by a tooth arrangement at both ends. A free end of the first and of the last support strip located in the cylinder groove are connected, fixed against relative rotation, which itself is fastened, with its parts covering the cylinder groove, to an end coupling piece to the flanks of the cylinder, for example by screwing.

A device for clamping and releasing of flexible plates with beveled suspension legs is known from DE 199 24 787 A1. Two cooperating strips are provided in a cross-sectional surface extending axially in respect to a groove, which two strips are charged in opposite directions by a spring with a force. Each end of the two springs is supported on an interior wall of a base body arranged in the groove. A support point of the springs is located substantially orthogonally with respect to the bearing point of the springs. Although the springs exert the force on the strips, which force is necessary for clamping, they do not simultaneously fix all of the strips in place in their bearing points during clamping.

SUMMARY OF THE INVENTION

The object of the present invention is directed to providing devices for fastening at least one dressing on a cylinder of a rotary printing press, and to a printing group having these devices.

In accordance with the invention, this object is attained by the provision of a cylinder of a rotary printing press that is provided with an axially extending groove having spaced first and second walls. At least one packing or dressing end holding device, and at least one spring element are situated in the groove with the holding device being usable to hold the packing trailing end. The holding device is embodied as a pivotable lever which is supported in the groove at a bearing point opposite to the groove's opening at the cylinder surface. The spring element is supported on the groove walls and exerts both a clamping force and a fixing or securement force on the holding device.

The advantages to be gained by the present invention reside, in particular, in that an embodiment of the device of the present invention, which is simple and which can be produced cost-effectively, is possible, which is provided with a holding element, or with a clamping element, for fastening at least one dressing on a cylinder of a rotary printing press.

In particular, in connection with pressing the holding element or device, or the clamping element, against a wall of the opening of the groove, an effective clamped fastening of at least one leg of a dressing, introduced into the opening of the groove, which dressing rests on the surface of the cylinder, can be provided. The holding element, or the clamping element, is simultaneously dependably fixed in place in the groove.

Neither a profiled strip provided with three strip-shaped arms, which is configured in a complicated manner, nor a clamping roller, which must be guided between the profiled strip and a support strip used as an abutment and which must be pressed against a suspension leg resting against the groove wall, for the purpose of an indirect clamping, are required, in accordance with the present invention, for fastening the dressing. In the same way, a coupling between adjoining support strips and consisting, for example, of a tooth arrangement, for arranging the individual support strips in the cylinder groove in a manner fixed against relative rotation, is also omitted. In accordance with the solution proposed by the present invention, the clamping device is supported in the groove of the cylinder itself. If several clamping devices are arranged in the groove of the cylinder, this characteristic applies to each individual clamping device. Thus, the prior art structure of a clamping device, as depicted in DE 199 24 785 A1, and consisting of at least a profiled strip, a support strip and a clamping roller, is made simpler and therefore more cost-effective by the present invention.

An embodiment of the device in accordance with the present invention, wherein at least the leg of the trailing end of the dressing has been at least partially configured as a rocker, is particularly advantageous. Following the introduction of the leg into the opening of the groove, this rocker is supported with its bearing point on the wall of the opening or on the wall of the groove. In the process, the clamping element braces the dressing with it leg embodied as a rocker.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
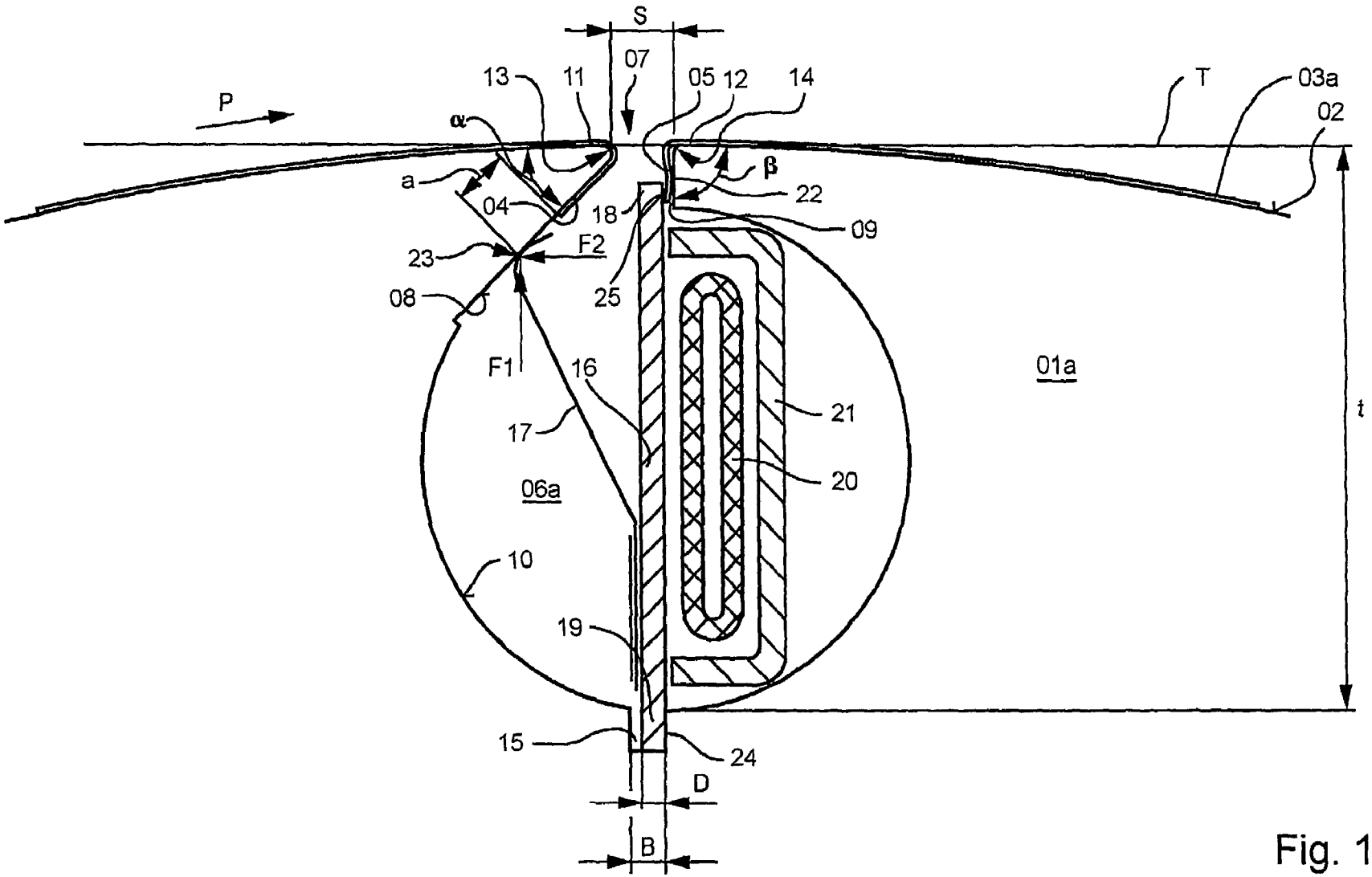
FIG. 1, a first embodiment of a device, in accordance with the present invention, for fastening a plate-shaped printing forme on a cylinder, in FIG. 2, a second preferred embodiment of a device for fastening a printing blanket, which transmits a printed image, on a cylinder, and in FIG. 3, a printing group of a rotary printing cress in accordance with the present invention.

In accordance with a first preferred embodiment of the present invention, as represented in FIG. 1, a dressing 03*a*, for example a plate-shaped printing forme 03*a*, is fastened on a surface 02 of a cylinder 01*a*. Beveled leading and trailing legs 04, 05 respectively, situated at the ends of the dressing 03*a*, are introduced into a groove 06*a* which is arranged in cylinder 01*a*, which groove 06*a* has an opening 07 pointing toward the surface 02 of the cylinder 01*a* plate end legs 04, 05 are substantially placed against walls 08, 09, of groove 06*a*, which walls are located near the surface, and adjacent the opening 07 of groove 06*a*. The legs 04, 05 can also partially rest against an inner wall 10 of the groove 06*a*, situated in groove 06*a* away from the area of the opening 07 and located deeper in the interior of the cylinder 01*a*. A boundary between the walls 08, 09 of the opening 07 and the wall 10 of the groove 06*a* extends seamlessly. An introduction depth of the legs 04, 05 is not exactly fixed, but instead embraces a large tolerance range. The groove 06*a* can have various cross-sectional diameters. However, a circular cross section, as represented in both drawing figures, is advantageous from the viewpoint of production technology.

Without limiting the invention to the simplified representation which follows, the description of the invention will be provided here for simplicity's sake in such a way as if only one dressing, extending completely around the circumference of the cylinder, were to be fastened. It is clear to one skilled in the art that several dressings could, in accordance with the invention described here, be fastened to the cylinder, in either its axial direction as well as in its circumferential direction. In case of the provision of several dressings, situated after each other in the circumferential cylinder direction, several grooves are also provided.

Viewed in the production or cylinder rotation direction P, the dressing 03*a* to be fastened on the cylinder 01*a* has a leading end 11 and a trailing end 12, each with a beveled leg 04, 05, respectively. Also, viewed in the production direction P of the cylinder 01*a*, the opening 07 of the groove 06*a* has a front edge 13, from which the first, leading wall 08 extends toward the groove 06*a*, as well as a rear edge 14, from which the second, trailing wall 09 also extends in the direction toward the groove 06*a*. The opening 07 on the surface 02 of the cylinder 01*a* is embodied to be long and narrow, and is therefore slit-shaped. A slit width S in the cylinder surface 02, in comparison with a depth "t" of the groove 06*a*, which depth "t" can be 30 mm, for example, is slight and is of such a size, that a leg 04 of a leading end 11 of a dressing 03*a* and a leg 05 of a trailing end 12 of dressing 03*a*, or in case of several dressings fastened in the circumferential direction of the cylinder 01*a*, of an identical dressing 03*a*, can be arranged one behind the other in the opening 07. Slit widths of less than 5 mm, and preferably in the range of between 1 mm and 3 mm, are advantageous.

Figure 2:
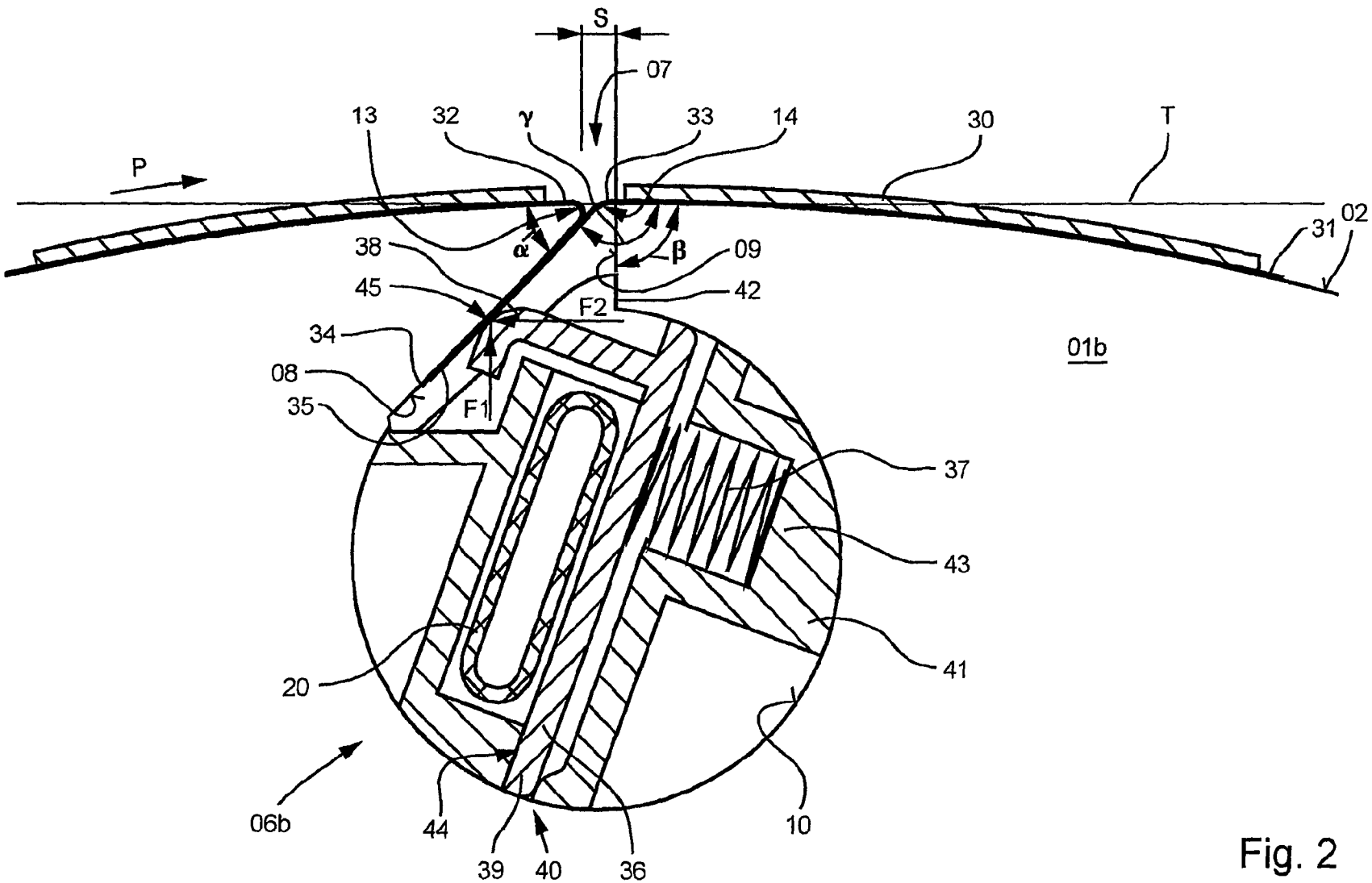

Between the leading wall 08 extending from the slit or groove opening front edge 13 toward the groove 06*a*, and an imagined tangent line T resting on the surface 02 of the cylinder 01*a* against the opening 07, an acute angle $\alpha$ has been formed, as seen in FIGS. 1 and 2 and which angle $\alpha$ is between 40° and 50°, and is preferably 45°. Thus, the groove opening or slit 07 tapers, or becomes narrower toward the surface 02 of the cylinder 01*a*, and it widens toward the interior of the groove 06*a*. The leg 04 of the leading end 11 of the dressing 03*a* can be suspended on the front edge 13 of the opening 07, so that this leg 04 rests, preferably with positive contact, against the first leading wall 08 extending from the groove front edge 13 to the groove 06*a*. In the preferred embodiment of the present invention represented in FIG. 1, the groove opening or slit second, trailing wall 09 drops at the rear edge 14 of the slit or opening 07 approximately vertically or radially inwardly toward the groove 06*a*. However, the wall 09 can be slightly inclined, so that the opening 07 widens toward the groove 06*a*. An angle $\beta$, which is defined as the opening angle between the trailing wall 09 extending from the slit or opening 07 rear edge 14 toward the groove 06*a*, and the previously mentioned tangent line T resting on the surface 02 of the cylinder 01*a* against the opening 07, lies in a range of between 80° and 95°, for example, and is preferably 90°.

As a rule, the groove 06*a* extends parallel with respect to an axis of rotation of the cylinder 01*a*. Approximately diametrically opposite the slit-shaped opening 07, a recess, for example a channel 15, is located in the inner wall 10 of the groove 06*a*, into which channel 15 a first, inner end of a plate-shaped, dimensionally stable holding device 16 is inserted, preferably loosely, and is pivotably seated. The channel 15 is a bearing point 24 and is a support point 24 of the holding device 16, which may be configured as a lever. In order to pivot the holding device 16 in the channel 15, a width B of the channel 15 is of a larger size than is a thickness D of the holding device 16.

In addition to the position of the bearing point 24 of the holding device 16 being located exactly diametrically opposite the opening 07 shown in FIG. 1 on the wall 10, and still in the area of the bottom of the groove 06*a*, this position can also deviate, in a clockwise direction, by up to approximately 30° from a vertical line starting at the opening 07 in a direction of the groove side facing the front edge 13. An angle of between 15° and 20° can be of particular advantage, as seen in FIG. 2.

The holding device 16 is embodied in such a way that it has a first, upper end 18, which can be placed against one of the two walls 08 or 09 of the opening 07, and a second, lower end 19, which is located opposite the opening 07. A spring element 17, for example a compression spring 17, that may be embodied as a leaf spring 17, is attached to the holding device 16 and is preferably directly supported on the wall 08 of groove 06*a* extending directly from the groove front edge 13 of the opening 07, or on the wall 10 of the groove 06*a*. Spring element 17 is situated in such a way, that the pivotably seated, second, lower edge 19 of the holding device 16 is fixed in place at its bearing point 24, i.e. is fixed in the channel 15. At the same time, the first, upper end 18 of the holding device 16 is pressed against the second, trailing wall 09 extending at the rear edge 14 of the opening 07. A clamping point 25 thus results at the first, upper end 18 of the holding device 16. By their cooperation, the holding device 16 and the spring element 17 constitute a clamping device effective in the groove 06*a*. Preferably, the spring element 17 is pre-stressed and, in this way, stabilizes the holding device 16 in its position in the groove 06*a* and secures the holding device 16 against inadvertently falling out of the opening 07. To achieve this simultaneous clamping and fixation in place, it is necessary for the spring element 17 to exert, because of its support in the support point 23, and in particular because of the position and/or shaping of this support point 23, a force of sufficient size for fixing the holding device 16 in place at its bearing point 24, in particular by pushing the holding device 16 against its bearing point 24. Because of this force requirement, the support point 23 of the spring element 17 is arranged spatially closer to the groove opening 07 than to the bearing point 24 of the holding device 16. Fixation of the spring 17 in place is achieved, in a simple manner, in that the spring element 17 is preferably supported on the wall 08 extending from the front edge 13 of the opening 07, or preferably in direct contact with the wall 10 of the groove 06*a*, in such a way that forces F1, F2 are simultaneously received in the support point 23 of the spring element 17 in two directions, which forces F1 and F2 extend vertically with respect to each other in the cross-sectional plane of the groove 06*a*. This absorption of the forces becomes possible because the support point 23 is, in particular, located at a spot where, because of the acute angle α of the opening 07, the first leading wall 08, extending from the front edge 13 toward the groove 06*a*, forms an inclined surface which is facing the support point 23 of the spring means 17. Respective force components are formed, at this inclined surface, in the support point 23 of the spring element 17 as counterforces to the support force components F1, F2. One such force component, as the counterforce to F2, exerts a force required for clamping the leg 05 introduced into the opening 07. A further such force component acts in the direction of the bearing point 24 of the holding device 16 to press it into the channel 15 in order to stabilize its position, in the course of the rotation of the cylinder 01*a*. An alternative configuration of the inclined surface can consist with the wall 08 extending from the groove front edge 13 and having a recess or being shaped in such a way that the distribution of forces previously described can take place in the support point 23 of the spring element 17. A helical compression spring 17, which can be correspondingly arranged in the groove 06*a*, can also be employed as the spring element 17 and in place of the leaf spring 17. Although the support point 23 of the spring element 17 is preferably located directly on the wall 08, in the case of a dressing trailing end leg 05 configured to be longer, the support point 23 can also be located on the latter, so that the spring element 17 is indirectly supported on the wall 08. In the latter case, the spring element 17 is not in direct contact with the wall 08, although the above described division of forces occurs. The holding device 16 can be allowed to have vertical play in the channel 15, as long as it is assured that the holding device 16 does not slide out off the opening 07 in any operational situation and is fully functional for clamping.

In actual use, the support point 23 is preferably located on the wall 08 extending from the front edge 13 to the groove 06*a* and directly following an inner end of the leg 04 of the leading end 11 of dressing 3*a*, which dressing leading end 11 is suspended in the front edge 13, of the groove 06*a*. A distance "a" between the inner end of the leg 04 and the support point 23 is preferably less than 5 mm, and in particular is less than 3 mm. Several holding devices 16, with associated spring elements 17, can, of course, be arranged in the longitudinal direction of the groove 06*a*. Only a single holding device 16 is arranged in each cross-sectional plane of the groove 06*a*.

An actuating device 20, which acts counter to the contact pressure exerted by the spring element 17 via the holding element 16 on the wall 09 extending from the rear edge 14 of the opening 07, is provided in order to release the clamping provided by the holding device 16 on the wall 09, when required, by actuating the actuating device 20. The actuating device 20 preferably is a hose 20 extending in the longitudinal direction of the groove 06*a*, which hose 20 can be charged with a pressure medium, for example with compressed air, and which can be bordered by an abutment 21. In this case, the abutment 21 of this actuating device 20 is an enclosure supported on the inner wall 10 of the groove 06*a* and reduces, because of its shape, the volume increase of the hose 20 required for releasing the clamping, and in this way contributes to a shorter reaction time of the actuating device 20. In a different construction of the actuating device 20, an abutment 21, in the form herein described, may be unnecessary.

Furthermore, the embodiment of the present invention, as represented in FIG. 1, shows a particularly advantageous further embodiment, wherein the leg 05 of the trailing end 12 is configured as a rocker wherein, following the introduction of the leg 05 into the opening 07 of the groove 06*a*, a bearing point 22 of this rocker is supported on the wall 09 of the opening 07. Depending on the geometry that may be used for shaping the edge 14 of the opening 07 against which a leg 05, configured as a rocker, of the trailing end 12 of the dressing 03*a* has been placed, it might also be that the bearing point 22 of the rocker is already located on the wall 10 of the groove 06*a*. Thus, the dressing 03*a* has a beveled leg 05 on its trailing end 12, which trailing end beveled leg 05 is shaped in such a way that this leg 05 has a further bevel, projecting away from the wall 09, at an acute angle of, for example, 15°, which can be tilted into the bearing point 22 on the wall 09 of the opening 07, and because of which, the effective direction of the clamping of the leg 05 of the trailing end 12 is reversed. This further bevel also generates a tensile stress on the dressing 03*a* resting on the surface 02 of the cylinder 01*a*, which tensile stress pulls the trailing end 12 of the dressing 03*a*in the direction toward the front edge 13 of the opening 07. The position of the bearing point 22 of the rocker can be selected to be such that a lever arm will result between the bearing point 22 of the rocker and the bevel of the leg 05 at the edge 14 of the opening 07. This first lever arm is approximately twice as long as the one between the bearing point 22 of the rocker and the clamping point 25 between the leg 05 and the holding device 16. This solution has the advantage that production tolerances in the length of the dressing 03*a* can be compensated for in a simple manner. Dressings 03*a*of too great a length have a tendency to become displaced on the surface 02 of the cylinder 01*a*. Furthermore, with a dressing 03*a*, which does not rest fully on the surface 02 of the cylinder 01*a*, a break, for example of its trailing end 12, can occur because of the flexing action exerted on it in the course of the production process of the cylinder 01*a*. In accordance with the solution proposed here, the holding device 16 does not only clamp the dressing 03*a* in the previously described manner, the dressing 03*a* is additionally braced by the trailing leg 05, configured as a rocker. With an appropriate pre-tensioning of the spring element 17, the rocker of the leg 05 and the spring element 17 form an additional bracing system for the dressing 03*a*, in the course of their cooperation, and together with the holding device 16, and which automatically compensates for changes in the length of the dressing 03*a*.

FIG. 2 shows, as a second preferred embodiment of the present invention, a device for fastening a printing blanket 30, which is usable for transferring a printed image, to a cylinder 01*b*, for example to a transfer cylinder 01*b* of an offset printing press. The printing blanket 30 has been applied to a support plate 31, which rests on the surface 02 of the cylinder 01*b*, which is flexible, but dimensionally stable in its superficial extent, and which support plate 31 has beveled legs 34, 35 on its two oppositely located ends, which beveled legs 34, 35 are to be fastened in, and which can be introduced into a groove 06*b* that is oriented toward an opening 07 in the surface 02 of the cylinder 01*b*. The dressing 03*b* being used here, and consisting of blanket 30 and support plate 31, has, as a rule, a complex layer structure which, however, consists at least of a support plate 31 and a printing blanket 30 applied to it. Analogously to the first embodiment of the present invention represented in FIG. 1, the support plate 31 to be fastened on the cylinder 01*b* has a leading end 32 and a trailing end 33 in the production direction P of the cylinder 01*b*. Here, too, the opening 07 of the groove 06*b* has, viewed in the production direction P of the cylinder 01*b*, a front edge 13 with a first wall 08 extending into the groove 06*b*, and a rear edge 14 with a second wall 09 also extending into the groove 06*b*. Between the first wall 08 extending from the front edge 13 to the groove 06*b*, and an imagined tangent line T resting on the opening 07 in the surface 02 of the cylinder 01*b* an acute angle a has also been formed, which acute angle α lies between 40° and 50° and preferably at 45° The leg 34 of the leading end 32 of the support plate 31 rests, positively connected, against the first wall 08 extending from the front edge 13. In contrast to the first embodiment represented in FIG. 1, in the second embodiment, the leg 35 of the trailing end 33 of the support plate 31 preferably also rests against the first wall 08, and in this case preferably rests, with the greater part of its surface and preferably being frictionally connected, directly on the leg 34 of the leading end 32 of the support plate 31. The leg 35 of the trailing end 33 of the support plate 31 therefore is beveled at an obtuse angle y, which obtuse angle y lies within the range of 130° and 140°, and preferably which is about 135° as seen in FIG. 2. The second wall 09 extending from the rear edge 14 toward the groove 06*b*, together with the previously mentioned tangent line T resting on the opening 07 in the surface 02 of the cylinder 01*b*, forms an angle β, the same as has been discussed in the previously described example, angle β which lies within the range between 80° and 95° and preferably is almost a right angle.

A clamping element 36 which, in this example is provided with a projecting arm and which is dimensionally stable per se, has a first, upper end 38 and a second, lower end 39, wherein the second, lower end 39 is pivotably seated in a bearing point 40, preferably close to the bottom of the groove 06*b*, wherein the bearing point 40 is embodied as a recess in a base 41, for example, and the recess has a supporting suface 44, for example, for the lower end 39 of the clamping element 36. The bearing point 40 of the clamping element 36 can, as was previously explained in connection with the first embodiment of the invention, deviate, in a clockwise direction, by up to 30° from a vertical line starting at the opening 07 on the side facing the front edge 13. An angle of deviation of between 15° and 20° can be advantageous in particular. The base body 41 is preferably secured against twisting in the groove 06*b*. The base body 41 can be made of a plastic material or of a metallic material. If several clamping elements 36 are provided in the longitudinal direction of the groove 06*b*, each of the clamping elements 36 can be arranged in a separate base body 41, and the base bodies 41 can be lined up against each other in the groove 06*b*.

By the use of a spring element 37, for example of a helical compression spring 37 or of a leaf spring 37, which is preferably encased in the base body 41 and which is supported therein at a support point 43 and which forms a clamping device, together with the clamping element 36, a contact pressure is exerted. The first, upper end 38 of the clamping element 36 exerts this clamping pressure on the legs 34 and 35, which are resting on top of each other and against the wall 08 of the front edge 13, because of which clamping pressure, both legs 34 and 35 are clamped to the first wall 08. The first, upper end 38 of the clamping element 36 is supported at a clamping point 45 between the clamping element 36 and the leg 35, at the trailing end 33 of the support plate 31 of the dressing 03*b*, on the wall 08 extending from the front edge 13 of the opening 07, or on the wall 10 of the groove 06*b*, in such a way that forces F1, F2 at the clamping point 45 are simultaneously absorbed in two directions, which forces F1, F2 extend vertically on top of each other in the cross-sectional plane of the groove 06*b*. Because of the acute angle α, the clamping point 45 again lies on an inclined surface. With this preferred embodiment, the clamping point 45 therefore lies in the area of the wall 08 which is covered by the two legs 34 and 35 which two legs 34 and 35 lie on top of each other. The clamping device with the pivotably seated clamping element 36, and in particular with the bearing point 40 of the clamping element 36, remains fixed in place in the groove 06*b* because of its support and because the force distribution provided along with it.

The spring element 37 is preferably pre-stressed and, in particular in cooperation with the security against twisting provided by the base body 41, it causes, by the action of its force on the clamping element 36, the seating, fixed in place, of the clamping element 36 by the effect of a force component of sufficient size. In the second preferred embodiment, which is represented in FIG. 2, the groove 06*b* has a circular cross section. The base body 41 is preferably matched, in its outer shape, to the contours of the groove 06*b*, or is supported by at least three support points on the wall 10 of the groove 06*b*. For example, an arresting element 42, which may be formed as a stop for the base body 41, projects into the opening 07 and is supported on the second wall 09 of the opening 07. In this way, the base body 41 is secure against twisting, in particular in a circular groove 06*b*. Such a twist prevention of the relatively inexpensive base body 41 is, in particular, of advantage if, for example, no channel 15 is provided for the holding device 16 or for the clamping element 36 in the groove 06*a*, 06*b*, the cutting of such a channel 15 having been omitted for reasons of cost. With an appropriate cross-sectional geometry of the groove 06*b*, for example an angular geometry, the base body 41 can be configured in such a way that it is supported, secure against twisting, on the wall 10 of the groove 06*b*.

An actuating device 20 has been provided in the base body 41, which actuating device 20 counteracts the contact pressure exerted by the spring element 37, via the clamping element 36, on the first wall 09 of the opening 07 in order to release, when desired, the clamping caused by the clamping element 36 on the first wall 09 when the actuating device 20 is operated. The actuating device 20 is again preferably a hose 20 that is provided extending in the longitudinal direction of the groove 06*b*, which hose 20 can be charged with a pressure medium, for example with compressed air, and which hose 20 can be encased by the base body 41.

With this second preferred embodiment, it is also assumed that only a single clamping element 36 is arranged in each cross-sectional plane of the groove 06*b*. Several such clamping elements 36, with associated compression springs 37, can easily be arranged in the longitudinal direction of the groove 06*b*. It is common to both of the depicted and described embodiments that a holding device 16, or a clamping element 36, is pivotably, and is preferably loosely, seated in the groove 06*a*, 06*b* by one end, i.e. by only one end 19, 39, and wherein clamping of the leg 05, 35 of the trailing end 12, 13 of the dressing 03*a*, or of the support plate 31, as well as a fixation in place of the holding device 16, or of the clamping element 36, in their bearing points 24, 40 is achieved by the use of a spring element 17, 37, which spring element is in operative connection with the holding device 16, or with the clamping element 36. Fixation in place of the clamping device, which is formed by the holding device 16, or by the clamping element 36, and the spring element 17, 37 takes place in such a way that, with the inclusion of the clamping point 25, 45 existing between the holding device 16, or the clamping element 36, and the leg 05, 35 of the trailing end 12, 33 of the printing forme 03*a*, or of the support plate 31, because of its pre-stress, the spring element 17, 38 stabilizes the holding device 16, or the clamping element 36, secure against twisting, if necessary with the aid of an arresting element 42 formed on the base body 41. Although the bearing point of the holding device 16, or of the clamping element 36, does allow the holding device 16, or the clamping element 36, to pivot, it is fixed in place, at least during the clamping process, with respect to its position in, or in relation to, the groove 06*a*, 06*b*. In this embodiment, the spring element 17, 37, or the holding device 16 or the clamping element 36, is supported indirectly or directly at a support point 23, 45 on that wall 08, 09 which, in the opening 07, is located opposite that wall 08, 09 on which the stop 42 is supported.

Thus, each of the above-described embodiments of the present invention is directed to a device for fastening at least one dressing 03*a*, or a support plate 31, on a cylinder 01*a*, 01*b*, having a clamping device, fixed in place secure against twisting on a wall 10 of the groove 06*a*, 06*b*, or on the walls 08, 09 of the opening 07, with a holding device 16, or with a clamping element 36 pivotably seated in, or at the bottom of the groove 06*a*, 06*b*, and wherein the clamping device is arranged in a base body 41, if desired. A spring element 17, 37 or a clamping element 36, at the same time, absorb, in their support point 23, or in their clamping point 45, forces F1, F2, extending in two directions vertically on top of each other in the cross-sectional plane of the groove 06*a*, 06*b*, and at the same time perform the two functions of clamping and of fixation in place by use of the resulting counter-forces.

Figure 3:
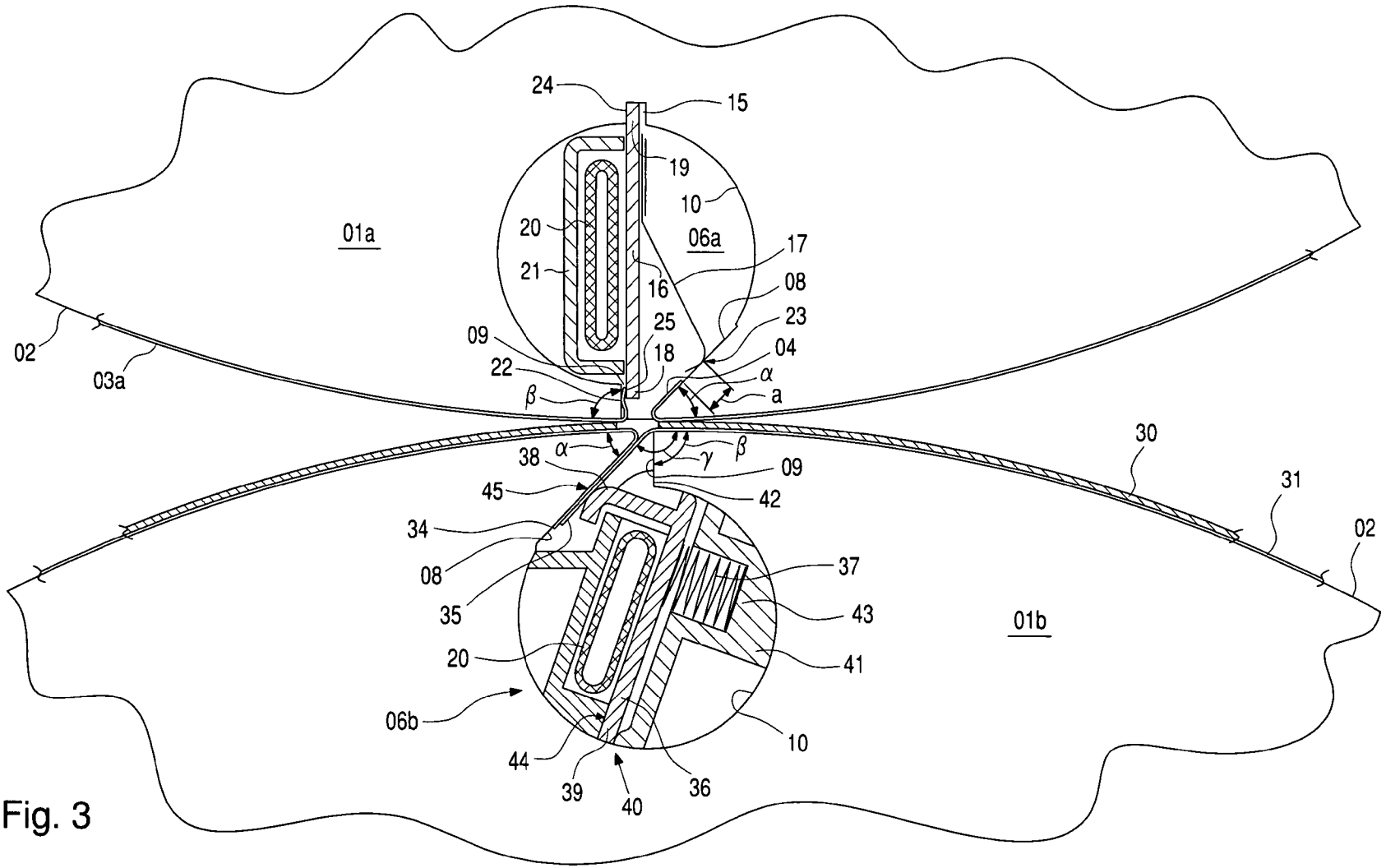

The above-described preferred embodiments of the device for fastening at least one dressing on a cylinder, in accordance with the present invention, can be realized in the same printing group of a rotary printing press, as is depicted schematically in FIG. 3. A cylinder 01*a*, with a printing forme 03*a* in accordance with the first preferred embodiment can roll oft on a cylinder 01*b* with a dressing 03*b* in accordance with the second exemplary embodiment. Thus, a plate-shaped printing forme 03 fastened on the surface 02 of the first cylinder 01*a* rolls off on a printing blanket 30, which has been applied to the surface 02 of the second cylinder Qib by the use of a support plate 31. In this case, the cylinder 01*a*, in accordance with the first preferred embodiment, constitutes a forme cylinder, and the cylinder 01*b*, in accordance with the second preferred embodiment, constitutes a transfer cylinder. Furthermore, the clamping device consisting of a holding device 16 and a leaf spring 17 and arranged in the groove 06*a* of the forme cylinder 01*a*, can be encased in a base body 41, wherein recesses in the base body 41 make possible the previously described pivotability and support of the clamping device.

In that case, this printing group is also distinguished, for example, by an approximately right angle β being formed between the wall 09 extending from the rear edge 14 to the groove 06*a* of the forme cylinder 06*a* and the tangent line T resting on the opening 07 in the surface 02 of the forme cylinder 01*a*. The trailing end 12 of the printing forme 03*a* is maintained on the wall 09 extending from the rear edge 14 to the groove 06*a*, and the leg 35 on the trailing end 33 of the support plate 31 forms an obtuse angle y with the tangent line T resting on the opening 07 of the transfer cylinder 01*b* and is maintained, together with the leg 34, at the leading end 32 of the support plate 31, on the wall 08 extending from the front edge 13 to the groove 06*b*.

While preferred embodiments of devices for fixing at least one packing to a cylinder of a rotary printing press and a printing group comprising such devices, in accordance with the present invention, have been set forth fully and completely hereinabove, it will be apparent to one of skill in the art that changes, for example in the overall sizes of the cylinders, in the specific structures of the packings or dressings and the like could be made without departing from the true spirit and scope of the present invention which is accordingly to be limited only by the appended claims.

What is claimed is:

1. A device for fastening at least one dressing on a cylinder of a rotary printing press comprising:

at least one groove in the cylinder and having an opening oriented at a surface of the cylinder;

a first groove opening wall and a second groove opening wall;

at least one dressing end holding device in said groove and having a first end adjacent said opening, said first end being adapted to releasably hold at least a dressing trailing end leg inserted into said opening, said holding device being a pivotable lever;

at least one spring element in said groove, said spring element exerting a clamping force and a securement force on said holding device;

a bearing point in said groove, said bearing point being opposite said opening, said bearing point receiving a second end of said holding device;

a support point for said spring element in said groove; and a clamping point for said dressing trailing end leg and defined by said holding device and one of said first and second groove opening walls, said clamping point being opposite said support point, said dressing trailing end leg being held against said one of said first and second groove opening walls at said clamping point by said clamping force exerted on said holding device, said spring element securing said holding device in said bearing point by said securement force exerted by said spring element, said support point being intermediate said clamping point and said bearing point.

2. The device of claim 1 further including a line tangent to said cylinder surface at said opening, said support point being on an other of said first and second groove opening walls, said other of said walls forming an inclined surface at an acute angle with respect to said tangent, said support point facing said bearing point.

3. The device of claim 2 wherein said acute angle is between 40° and 50°.

4. The device of claim 1 wherein the cylinder is supported for rotation in a production direction and further wherein said support point is on an other one of said first and second groove opening walls which other of said first and second groove opening walls is first in said production direction.

5. The device of claim 4 further including a groove front edge of said other of said first and second groove opening walls, said support point being located on said other of said first and second groove opening walls at a distance from said front edge.

6. The device of claim 5 wherein said distance is less than 5 mm.

7. The device of claim 5 wherein said front edge is adapted to hold a dressing leading end leg.

8. The device of claim 4 wherein said other of said first and second groove opening walls is adapted to hold a dressing leading end leg.

9. The device of claim 1 further including a rocker on said dressing trailing end leg, said rocker being located on said one of said first and second groove opening walls.

10. The device of claim 9 wherein said holding device engages said rocker.

11. The device of claim 1 wherein said cylinder is supported for rotation in a production direction and further wherein said clamping point is on said one of said first and second groove opening walls which is first in said production direction and further including a line tangent to said cylinder surface of said opening, said one of said first and second groove opening walls extending at an acute angle to said tangent line.

12. The device of claim 11 wherein said acute angle is between 40° and 50°.

13. The device of claim 11 wherein said first groove opening wall is adapted to hold a dressing leading end leg.

14. The device of claim 1 wherein said bearing point is adjacent a bottom surface of said groove.

15. The device of claim 1 wherein said spring element is a leaf spring.

16. The device of claim 1 wherein said spring element is pre-stressed.

17. The device of claim 1 further including an actuating means in said groove and adapted to act on said holding device in opposition to said spring element.

18. The device of claim 17 wherein said actuating means is a hose adapted to be charged with a pressure medium.

19. The device of claim 1 wherein said bearing point is fixed in place in said groove.

20. The device of claim 1 further including at least one base body in said groove, said at least one base body having said holding device and said spring element, said holding device being pivotably supported in said base body.

21. The device of claim 20 wherein said base body is supported in said groove fixed against rotation.

22. The device of claim 20 further including a stop on said base body and projecting into said opening, said stop fixing said base body in said groove against rotation.

23. The device of claim 22 wherein said stop is supported opposite to said clamping point.

24. The device of claim 1 wherein said groove is circular in cross-section.

25. A printing group of a rotary printing press comprising:

at least one forme cylinder;

at least one transfer cylinder adapted to cooperate with said forme cylinder;

at least one plate-shaped printing forme secured to said forme cylinder;

at least one support plate with a printing blanket on said transfer cylinder;

means supporting said forme cylinder and said transfer cylinder for rotation in a production direction;

a leading end with a beveled leg and a trailing end with a beveled leg on each said printing forme and said support plate;

at least one end leg receiving groove in each said forme cylinder and said transfer cylinder, each said groove having an opening extending toward a surface of each said cylinder, each said opening having a front edge and a first wall and a rear edge and a second wall, said first wall extending at an acute angle to a line tangent to said surface at said opening, said leading end of said printing forme and of said support plate being suspendable from said front edge;

a printing forme trailing end leg holding means in said groove in said forme cylinder and including a pivotable lever supported for pivotable movement in a bearing point opposite said opening, and a spring element engagable with said pivotable lever and with one of said first and second walls at a support point, said spring element providing a clamping force acting on said pivotable lever for holding said trailing end leg in a clamping point against one of said first and second opening walls opposite said support point, said spring element providing a securement force for holding said pivotable lever in said bearing point; and a support plate trailing end leg clamping element in said groove in said transfer cylinder and including a clamping element pivotable lever with a first end and a second end, said clamping element second end being supported in a clamping element bearing point opposite said opening in said transfer cylinder, and a clamping element spring in said groove, said clamping element spring exerting a clamping force and a securement force against said clamping element, said clamping element first end exerting a clamping force against said trailing-end leg placed against said first wall of said opening in said transfer cylinder.

26. The printing group of claim 25 wherein a right angle is formed between said forme cylinder second wall and said tangent line, said printing forme trailing end being supported on said forme cylinder second wall.

27. The printing group of claim 25 wherein an obtuse angle is formed between said support plate trailing end with respect to said tangent line, said support plate trailing end being supported on said first wall of said transfer cylinder.

28. The printing group of claim 25 wherein said opening has a width of less than 5 mm.

* * * * *